US006963066B2

(12) United States Patent
Izgarian et al.

(10) Patent No.: US 6,963,066 B2
(45) Date of Patent: Nov. 8, 2005

(54) ROD ASSEMBLY IN ION SOURCE

(75) Inventors: Nicolae Izgarian, San Ramon, CA (US); Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 158 days.

(21) Appl. No.: 10/456,372

(22) Filed: Jun. 5, 2003

(65) Prior Publication Data

US 2004/0245453 A1 Dec. 9, 2004

(51) Int. Cl.[7] ..... H01J 49/10
(52) U.S. Cl. ..... 250/288
(58) Field of Search ..... 250/288

(56) References Cited

U.S. PATENT DOCUMENTS

| | | | |
|---|---|---|---|
| 5,576,540 | A | 11/1996 | Jolliffe |
| 5,847,386 | A | 12/1998 | Thomson et al. |
| 5,969,350 | A | 10/1999 | Kerley et al. |
| 6,157,030 | A | 12/2000 | Sakairi et al. |
| 6,331,702 | B1 | 12/2001 | Krutchinsky et al. |
| 6,498,690 | B2 | 12/2002 | Ramm et al. |
| 6,504,150 | B1 | 1/2003 | Verentchikov et al. |
| 6,617,577 | B2 | 9/2003 | Krutchinsky et al. |
| 2002/0079443 | A1 | 6/2002 | Krutehinsky |
| 2002/0175278 | A1 | 11/2002 | Whitehouse |
| 2003/0098413 | A1 | 5/2003 | Weinberger et al. |

FOREIGN PATENT DOCUMENTS

| | | | |
|---|---|---|---|
| EP | 1 267 387 | A2 | 12/2002 |
| EP | 1 284 495 | A2 | 2/2003 |

OTHER PUBLICATIONS

Oleg Kornienko; Earl T. Ada; Jillian Tinka; Muthu B.J. Wijesundara; Luke Hanley: "Improved Desorption/Photoionization Configuration for Organic Surface Analysis by Two Laser Ion Trap Mass Spectrometry", 46$^{th}$ ASMS Conference on Mass Spectrometry and Allied Topics, May 31–Jun. 4, 1998, Orlando, Florida (1 page).

Benjamin M.Chien; Steven M. Michael; David M. Lubman: "Enhancement of Resolution in Matrix–assisted Laser Desorption Using an Ion–trap Storage/Reflectron Time–of–Flight Mass Spectrometer", Rapid Communications in Mass Spectrometry, Sep. 1993, vol. 7, No. 9, pp. 837–843.

Roland S. Annan Heinrich J. Köchling, James A. Hill, Klaus Biemann: "Matrix–assisted Laser Desorption Using a Fast–atom Bombardment Ion Source and a Magnetic Mass Spectrometer", Rapid Communications in Mass Spectrometry, 1992, vol. 6, pp. 298–302.

K. Tanaka, H. Waki, Y. Ido, S. Akita, Y. Yoshida, T. Yoshida; "Protein and Polymer Analyses up to m/z 100 000 by Laser Ionization Time–of–flight Mass Spectrometry," Rapid Communications in Mass Spectrometry, 1988, vol. 2, pp. 151–153.

*Primary Examiner*—John D. Lee
*Assistant Examiner*—Phillip Johnston
(74) *Attorney, Agent, or Firm*—Fish & Richardson P.C.

(57) ABSTRACT

Ion source assemblies for generating ions for laser desorption mass spectrometry. An ion source assembly includes a target for receiving analyte samples and a plurality of rods. The rods define an interior volume having an axis extending away from a surface of the target for transporting ions. One or more of the rods include an aperture defining an opening through a cross-section of the rod. The aperture is configured such that a laser beam can pass through the aperture to irradiate a location on the target surface to generate ions from an analyte sample deposited at the location.

23 Claims, 3 Drawing Sheets

ROD ASSEMBLY IN ION SOURCE

BACKGROUND

The present invention relates to ion sources in mass spectrometers.

A mass spectrometer analyzes masses of molecules, such as ions, and includes an ion source and one or more mass analyzers. In the ion source, particles are ionized and extracted from a sample that includes analyte molecules, i.e., molecules to be analyzed. The ions are transported to one or more mass analyzers, e.g., time-of-flight, ion trap or multipole analyzers, that analyze the ions based on their mass-to-charge ratio.

In the ion source, the particles can be ionized by a variety of techniques, e.g., using static electric fields or laser, electron, or other particle beams. For example, in a laser desorption ionization (LDI) technique, a laser beam, typically delivered in pulses, is focused on a surface of a sample from which the focused laser ablates particles. The laser's wavelength can be adjusted to selectively heat and ablate analyte molecules in the sample. Near the sample surface, the ablated particles form a "plume" of particles, including ionized analyte molecules and, for large analyte molecules, fragments of the molecules.

Fragmentation can be avoided using matrix-assisted laser desorption ionization ("MALDI") techniques. In MALDI, analyte molecules are embedded in a matrix, which typically includes small organic molecules. For example, the analyte and matrix molecules can be mixed in a solvent, which is later removed, e.g., by drying the solution. In this technique, the laser's energy is absorbed mainly by matrix molecules that heat up and vaporize into a particle plume. The matrix molecules drag along the analyte molecules into the plume where analyte molecules become ionized.

From the particle plume created by the laser beam, analyte ions can be guided to a mass analyzer, e.g., by multipole rod assemblies, such as a quadrupole rod assembly in which four parallel rods create a quadrupole electric field to guide the ions from the sample surface to the analyzer. To avoid distortions of the quadrupole field, the laser beam irradiates the sample through a gap between the quadrupole rods.

SUMMARY

The invention provides techniques for generating analyte ions in an ion source of a mass spectrometer, where a laser beam irradiates a sample through an aperture in a rod of a rod assembly for transporting ions. In general, in one aspect, the invention provides an ion source assembly for laser desorption mass spectrometry. The ion source assembly includes a target for receiving analyte samples and a plurality of rods. The rods define an interior volume having an axis extending away from a surface of the target for transporting ions. One or more of the rods includes an aperture defining an opening through a cross-section of the rod. The aperture is configured such that a laser beam can pass through the aperture to irradiate a location on the target surface to generate ions from an analyte sample deposited at the location.

Particular implementations can include one or more of the following features. The ion source assembly can be included in a matrix assisted laser desorption ion source. The plurality of rods can include multipole rods, where each of the multipole rods defines a multipole surface configured to generate multipole electric fields in the interior volume. A rod including an aperture can be a multipole rod defining the aperture through the multipole surface of the multipole rod. The aperture through the multipole rod can have a minor diameter between about 1.0 mm and about 2.5 mm, e.g., between about 1.3 mm and about 2.0 mm, at the multipole surface. A metal mesh can cover the aperture through the multipole rod at the multipole surface. The metal mesh can define a plurality of openings. Each opening can have a linear size of about 0.5 mm. A rod including an aperture can define the aperture by a recess. The plurality of rods can include accelerating rods configured to accelerate or decelerate ions along the axis of the interior volume. A rod including an aperture can be an accelerating rod defining the aperture by a recess. In one or more of the rods including an aperture, the aperture can be configured such that a laser beam can pass through the aperture at an incident angle that is less than sixty degrees, e.g., about thirty-two degrees, relative to the axis of the interior volume. The target for receiving an analyte sample can be defined by indentation on a sample plate.

The ion source assembly can include an optical component configured to irradiate a location on the target surface with a laser beam through an aperture in one or more of the rods. The ion source assembly can include an imaging component configured to image the target surface using visible light passing through the aperture used by the laser beam irradiating the target surface. The optical component can include a dichroic mirror to direct the laser beam to the target surface and visible light to the imaging component.

In general, in another aspect the invention provides a method for generating ions in an ion source assembly for laser desorption mass spectrometry. The method includes positioning in the assembly a target including an analyte sample, and irradiating with a laser beam a location on the analyte sample to generate analyte ions, where the laser beam is passing through an aperture defined by an opening through a cross-section of one of a plurality of rods in the ion source assembly, the plurality of rods being configured to transport the generated analyte ions.

Particular implementations can include one or more of the following features. The generated analyte ions can be transported in an interior volume defined by the plurality of rods, where the interior volume has an axis extending away from a surface of the target. Transporting the generated analyte ions in the interior volume can include generating multipole electric fields in the interior volume with the multipole rods in the plurality of rods. Irradiating with a laser beam a location on the analyte sample can include irradiating with a laser beam that passes through an aperture in one of the multipole rods. The laser beam can pass through a metal mesh covering the aperture in one of the multipole rods. The laser beam can pass through the aperture at an incident angle that is less than sixty degrees relative to the axis of the interior volume.

The invention can be implemented to realize one or more of the following advantages. Through an aperture in a rod of a rod assembly for transporting ions, laser beams can irradiate a sample surface to generate analyte ions with high efficiency. To provide a uniform energy distribution on the sample surface, the aperture can be configured such that the laser beam has a small incident angle relative to the normal of the sample surface. The sample surface can be irradiated even if there is not enough room for a laser beam to pass between rods in the rod assembly, e.g., when the assembly includes both multipole rods for guiding and accelerating rods for accelerating or decelerating the analyte ions, or when the combination of rod diameter and rod positioning does not allow adequate access for the laser beam. The sample surface can be irradiated through the aperture without damaging transportation properties of the rod assembly. For example, the aperture can be in a multipole rod generating multipole electric fields for guiding the ions, and a mesh can be placed on the aperture to minimize distortions of the electric field. Alternatively, the aperture can be defined by a recess in an accelerating rod. Visible light can pass through the aperture to image the sample surface, for example, using a charge-coupled device ("CCD") camera. The visible light can be focused on the sample surface through the same optics as the laser beam. The multipole rod assembly can be positioned within about 0.5 mm and about 2 mm from the sample surface to maximize efficiency of transferring ions from the sample to the multipole rod assembly.

The details of one or more implementations of the invention are set forth in the accompanying drawings and the description below. Other features and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
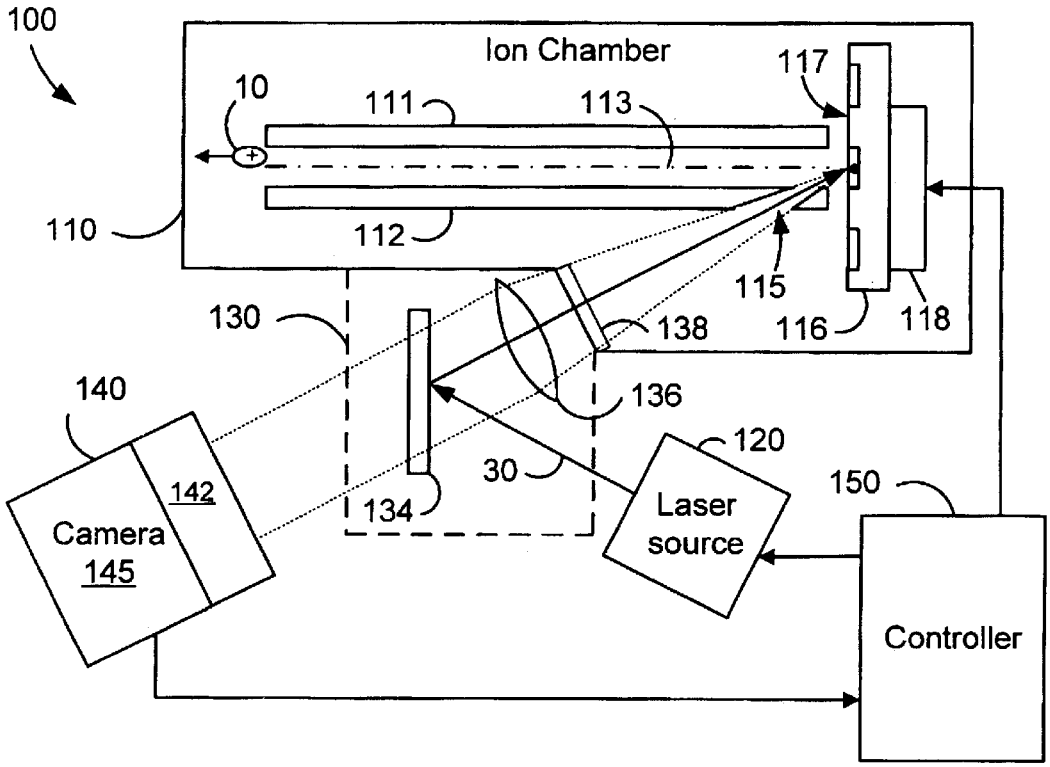
FIGS. 1A–1C are schematic diagrams illustrating an ion source assembly.

FIG. 1A illustrates an ion source assembly 100 that can be used to generate analyte ions 10 and transport the generated ions to other devices, e.g., to a mass analyzer of a mass spectrometer. The ion source assembly 100 includes an ion chamber 110, a pulsed laser source 120, an optical component 130, an imaging component 140, and a controller 150. To generate the analyte ions 10, the laser source 120 irradiates a sample 20 in the ion chamber 110 with a laser beam 30. (The sample 20 is illustrated in detail in FIGS. 1B and 1C.) The laser beam 30 can be aimed and focused on the sample 20 using the optical component 130. The controller 150 controls the laser source 120 and positions of the sample 20 in the ion chamber 110. The imaging component 140 images the sample 20 in the ion chamber and sends the images to the controller 150 to facilitate positioning the sample.

The analyte ions 10 are generated and transported in the ion chamber 110. In one implementation, the ion chamber 110 is a vacuum chamber maintaining medium vacuum. Alternatively, the ion chamber can include an amount of a gas (e.g., an inert gas with a small pressure—for example, on the order of millitorrs) that can collide with and thereby thermalize analyte ions that are heated up by the laser beam 30. By cooling, fragmentation of the analyte molecules can be decreased and the precision of the mass spectrum can be increased.

The ion chamber 110 includes rods 111–112, a sample holder 116, and a sample positioning apparatus 118. The sample holder 116 holds one or more samples, such as the sample 20, from which the analyte ions 10 are generated. In one implementation, the sample holder 116 defines a target plane 117 including multiple indentations for holding samples. For example, each indentation in the target plane 117 can have a circular shape with a diameter of, e.g., about two millimeters. Alternatively, the sample holder 116 can have indentations of any other shape or size, or can hold the sample 20 without any indentation. Samples and sample holders are further discussed with reference to FIGS. 1B and 1C.

The sample holder 116 is positioned by the sample positioning apparatus 118. For example, the positioning apparatus 118 can include a conventional stepper motor for each independent direction in which the sample holder 116 can be moved (e.g., two motors for two independent directions). The sample positioning apparatus 118 is configured to position the sample holder 116 such that samples can be irradiated with the laser beam 30. In one implementation, the sample positioning apparatus is configured to move the sample holder 116 in the target plane 117. Alternatively or in addition, the sample positioning apparatus 118 can move the sample holder perpendicular to the target plane 117.

The rods 111–112 are configured to transport analyte ions 10 from the sample holder 116 to other devices coupled to the ion source assembly 100. Optionally, the ion source assembly 100 can include collective ion optics (not shown) for focusing the analyte ions 10 generated from the sample to the devices coupled to the ion source assembly. For transporting the ions, the rods 111–112 define in an interior volume along an axis 113. In one implementation, the axis 113 is perpendicular to the target plane 117. Alternatively, the axis 113 can have an oblique angle relative to the target plane 117. In one implementation, the rods 111–112 include multipole rods for guiding and rods for accelerating or decelerating the analyte ions 10 along the axis 113. For example, the rods 111–112 can include quadrupole rods for guiding the ions and rods in between the quadrupole rods for accelerating or decelerating the ions, as discussed with reference to FIGS. 2A–3B. In alternative implementations, the rods 111–112 can include only multipole rods, such as quadrupole, hexapole, or octapole rods.

At least one of the rods 111–112 (rod 112 in FIGS. 1A and 1B) includes an aperture 115 that is configured such that the laser beam 30 can irradiate the sample 20 in the target plane 117 through the aperture 115. Aperture, as used in this specification, includes any opening into or through a rod, such as a hole, orifice, gap, cleft, slit or recess that is contained at least partly within the rod and through which the laser beam can pass. Defining the aperture 115 is further discussed with reference to FIGS. 1B and 2A–3B. Due to the laser irradiation, a plume of particles is formed from the sample 20 near the target plane 117 and the rods 111–112 guide the analyte ions from the particle plume along the axis 113. To effectively capture analyte ions in the plume, the rods 111–112 extend almost to the sample 20, e.g., to within less than about 1.5 mm from the target plane 117.

The laser source 120 provides the laser beam 30 to irradiate the sample 20. In one implementation, the laser source 120 is a laser device generating ultra violet ("UV") or infra red ("IR") laser beams. Alternatively, the laser beam can be generated by an external device and coupled to the ion source assembly by optical cable. In this implementation, the laser source 120 can be an optical cable coupling device.

The optical component 130 directs the laser beam 30 from the laser source 120 through the aperture 115 to the sample 20. Optionally, the optical component 130 can focus the laser beam on the sample. In one implementation, the optical component 130 includes a mirror 134, a lens element 136, and a window 138. The mirror 134 directs and the lens element 136 focuses the laser beam, which enters the ion chamber 110 through the window 138.

The mirror 134 is positioned to reflect the laser beam 30 to pass through the aperture 115. In one implementation, the laser beam includes light with non-visible wave lengths, e.g., a UV or an IR laser beam, and the mirror 134 is a dichroic mirror that reflects the non-visible laser beam but is transparent for visible light. The dichroic mirror can be used to separate visible light from the laser beam and makes it possible to use the optical component 130 for both directing the laser beam and imaging the sample in visible light. In alternative implementations, the laser beam 30 can be directed without the mirror 134. For example, the laser beam can be directed with an acoustooptic light deflector, or simply by positioning the laser source 120.

The lens element 136, e.g., a convex or plano-convex lens, focuses the laser beam on the target surface 117. The lens element 136 can be positioned between the mirror 134 and the window 138, or between the mirror 134 and the laser source 120. Optionally, the optical component 130 can include more than one lens. For example, a first lens can be positioned before and a second lens can be positioned after the mirror 134. In one implementation, both the first and second lenses are plano-convex lenses with a ratio of focal distances in between about 1:1 and about 1:3. Alternatively or in addition, the lens element 136, or one or more other lenses in the optical component 130, can be configured to image the sample 20, e.g., in visible light.

The laser beam 30 is directed through the window 138 to the sample 20 inside the ion chamber. The window 138 is configured to allow the laser beam 30 enter the ion chamber and to seal vacuum (or low pressure) in the ion chamber from outside atmospheric pressure. The window 138 can be made of fused silica or any other material that is transparent to the laser beam. In addition, the window 138 can be transparent to visible light passing into and out of the ion chamber. The visible light can be used to image the sample 20. The window 138 can have only flat surfaces or can be configured to focus the laser beam and/or visible light, e.g., can have a convex surface.

The imaging component 140 images the sample 20 in the ion chamber. In one implementation, the imaging component includes a light source 142 and a camera 145. The light source 142 provides light, e.g., visible light, that illuminates the sample and the camera 145, e.g., a CCD camera, generates an image by detecting light reflecting from the sample. In alternative implementations, the imaging component 140 can provide images without an electronic camera, e.g., by projecting the image of the sample on a screen.

As shown in FIG. 1A, between the sample and the imaging component 140, light can travel through the optical component 130 and the aperture 115. By using the optical component 130 and the aperture 115 in a manner similar to the laser beam 30, the imaging component 140 is able to image the sample with fewer elements than would otherwise be required, e.g., without extra windows on the ion chamber, or without additional apertures in the rods 111–112 that may distort the electric fields generated by the rods 111–112 for transporting the ions. In alternative implementations, the light source 142 can illuminate and the camera 145 can image the sample from other directions than the laser beam.

Optionally, the imaging component 140 can include a mirror or a half-transparent mirror, e.g., to arrange the light source 142 and the camera 145 such that the size of the imaging component 140 be minimized. For example, the light source 142 can shine light through the half-transparent mirror to the sample, and the light received from the sample can be reflected by the half-transparent mirror to the camera 145. In alternative implementations, one or more elements of the imaging component 140, e.g., the light source 142, can be inside the ion chamber.

The controller 150 controls the laser source 120 and the sample positioning apparatus 118 to aim and shoot the laser beam at a sample. For example, the controller 150 can instruct the sample positioning apparatus 118 to move the sample holder 116 such that the sample 20 will be positioned at the focus of the laser beam 30. Alternatively, the controller can instruct the laser source 120 and/or the optical component 130 to aim at the sample. Next, the controller can instruct the laser source 120 to irradiate the sample. Optionally, the controller 150 can receive an image of the sample from the imaging component 140 to facilitate aiming at the sample. Alternatively or in addition, a human operator can assist in aiming the laser beam, e.g., by using an image of the sample.

Figure 1B:
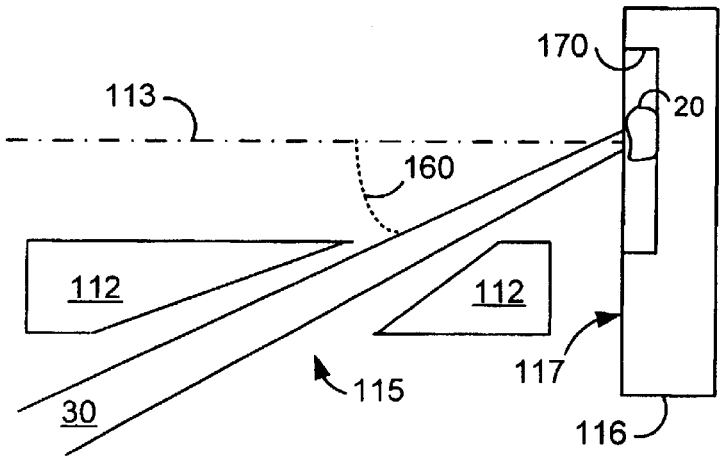

FIG. 1B illustrates details of irradiating the sample 20 with the laser beam 30 through the aperture 115, where the sample is held in an indentation 170 of the sample holder 116. The aperture 115 is implemented as an angled hole through the rod 112. The angle of the hole is configured such that the laser beam 30 has an oblique incident angle 160 relative to the axis 130. In one implementation, the incident angle 160 is less than sixty degrees, for example, between about thirty and about forty degrees, such as about thirty-two degrees. By having an incident angle less than about sixty degrees, the laser beam can irradiate the sample with a uniform energy distribution.

Figure 2A:
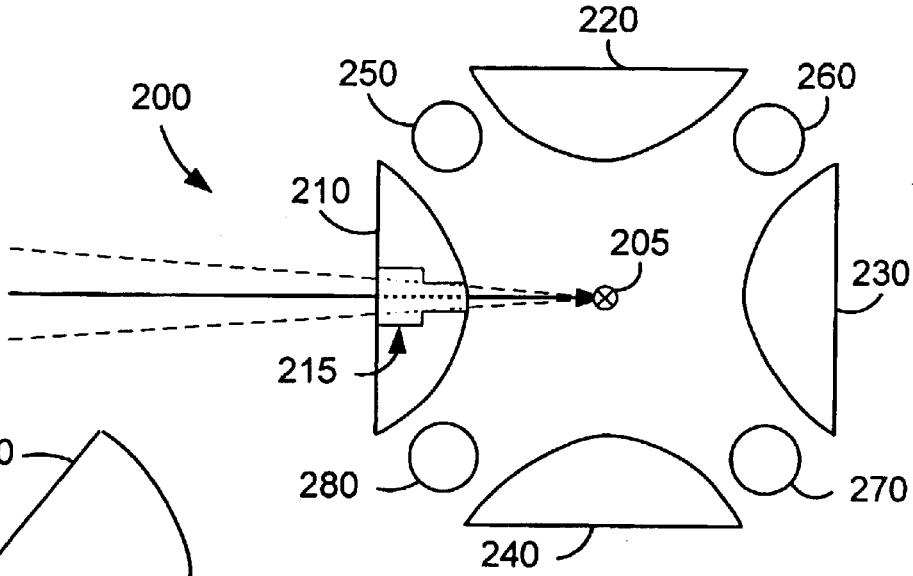
FIGS. 2A and 3A are schematic diagrams illustrating rod assemblies for ion sources.

The aperture 115 can be tapered, i.e., have a decreasing diameter, toward an inner surface 114 of the rod 112, where the inner surface 114 faces the axis 130. Tapering the aperture decreases the diameter of the aperture at the inner surface while allowing a broader angle for light beams that are used to image the sample. In addition, the laser beam can be more easily focused on the sample through a tapered aperture. In alternative implementations, the aperture 115 can be a counterbore hole that is narrowed to the inner surface 114 in one or more discrete steps (as shown in FIG. 2A). Optionally, the aperture can be implemented as an angled hole with constant diameter.

At the inner surface 114, the aperture 15 can have a minor diameter that is in between about 1.0 mm and about 2.5 mm, for example, in between about 1.3 mm and 2 mm, such as about 1.5 mm or about 1.8 mm. An aperture 115 having a minor diameter between about 1.0 mm and about 2.5 mm at the inner surface allows both convenient aiming of the laser beam and sufficient view for imaging the sample without causing substantial distortions to the electric field generated by the rod 112. Optionally, as discussed with reference to FIGS. 4A and 4B, the aperture can be covered with a mesh to further minimize the electric field distortions.

Figure 1C:
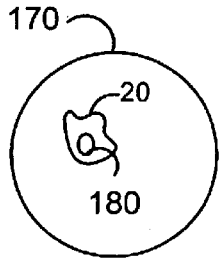

FIG. 1C illustrates the sample 20 in the indentation 170 viewed from the direction of the axis 113. In one implementation, the sample 20 is a MALDI sample that is prepared by dissolving matrix and analyte molecules in a solvent, the solution being deposited in the indentation 170 and dried. The laser beam 30 is aimed at a target spot 180 of the sample 20. The shape of the target spot 180 depends on the incident angle 160: the smaller the incident angle 160, the rounder the target spot 180. In a rounder target spot, the energy distribution ionizing the sample becomes more uniform. The size of the target spot depends on the size of the laser beam leaving the laser source 120 and the focusing in the optical component 130. In one implementation, the diameter of the target spot is between about 80 micrometers and about 150 micrometers.

FIG. 2A shows a cross section of a rod assembly 200 for transporting ions in ion source assemblies, such as the ion source assembly 100 shown in FIG. 1. The rod assembly 200 includes quadrupole rods 210, 220, 230, and 240 for guiding ions in an interior volume along an axis 205 that points perpendicular to the plane of the figure. The quadrupole rods are configured to generate a quadrupole electric field guiding ions in the interior volume.

The rod assembly 200 also includes rods 250, 260, 270, and 280 for accelerating or decelerating ions in the interior volume along the axis 205. Each of the rods 250–280 is positioned in a gap between two adjacent quadrupole rods. The rods 250–280 block the gaps between the quadrupole rods leaving insufficient room for irradiating or imaging a sample positioned on or near the axis 205.

Figure 2B:
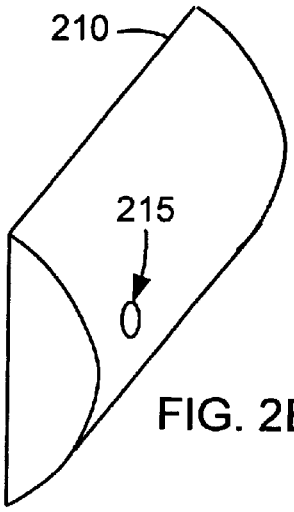
FIGS. 2B, 3B, 4A and 4B are schematic diagrams illustrating rods for rod assemblies.

A laser beam 290 and/or visible light 295 can reach a sample positioned on the axis 205 through an angled aperture 215 in the quadrupole rod 210. The aperture 215 is implemented as a counterbore hole. In alternative implementations, the aperture 215 can be a tapered or non-tapered hole. FIG. 2B shows a perspective view of the quadrupole rod 210 with the aperture 215.

Figure 3A:
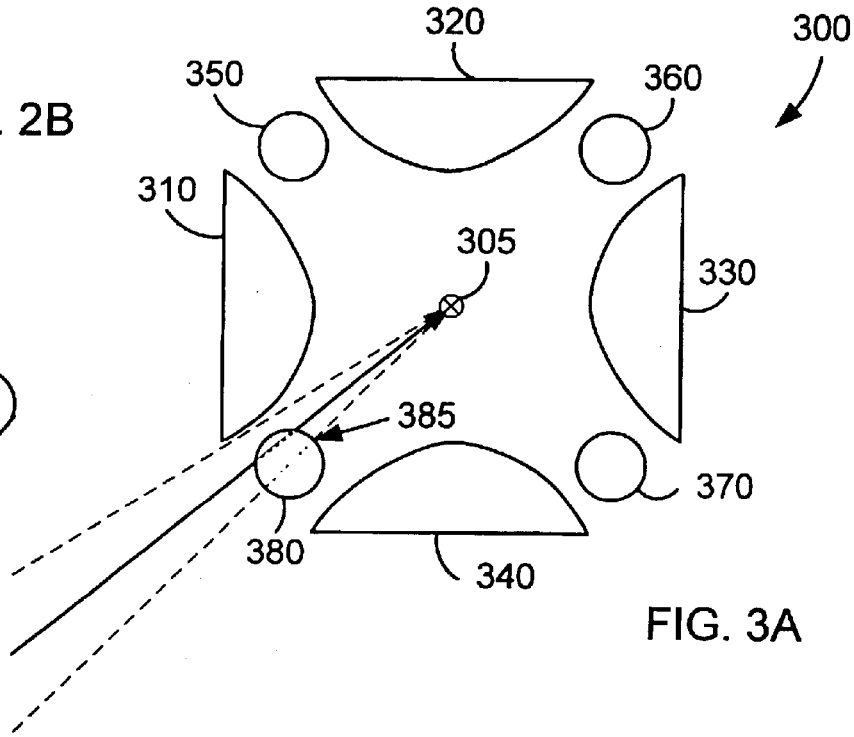

FIG. 3A shows a cross section of a rod assembly 300 for transporting ions in ion source assemblies, such as the ion source assembly 100 shown in FIG. 1. Similar to the rod assembly 200 shown in FIG. 2A, the rod assembly 300 includes four quadrupole rods (rods 310, 320, 330, and 340) for guiding ions in an interior volume along an axis 305, and four additional rods (rods 350, 360, 370, and 380) positioned in gaps between adjacent quadrupole rods for accelerating or decelerating analyte ions.

Figure 3B:
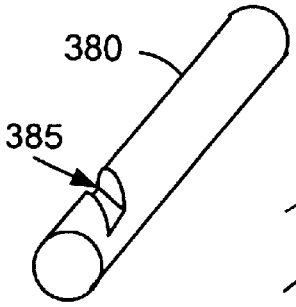

In this implementation, a laser beam 390 and/or visible light 395 can reach a sample positioned on the axis 305 through an aperture 385 in the rod 380. The aperture 385 is implemented as an angled recess in the rod 380. In alternative implementations, the aperture 385 can be implemented as a recess in a quadrupole rod, or a pair of adjacent rods, e.g., an accelerating and a quadrupole rod, can have a recess on opposing surfaces. FIG. 3B shows a perspective view of the rod 380 with the aperture 385.

Figure 4A:
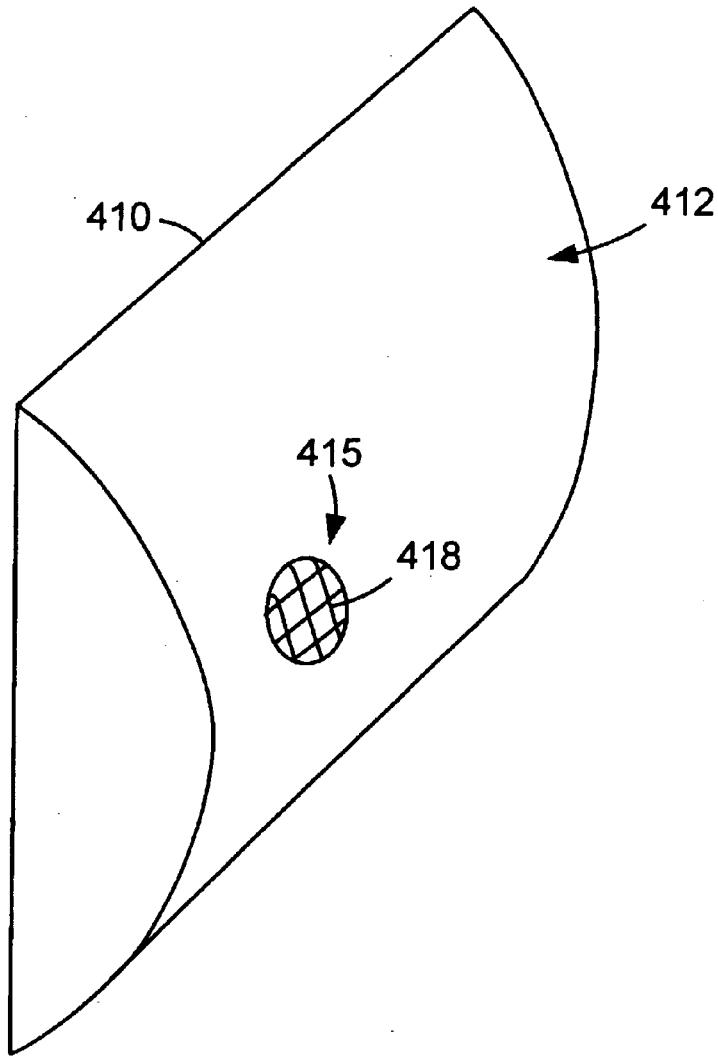
Figure 4B:
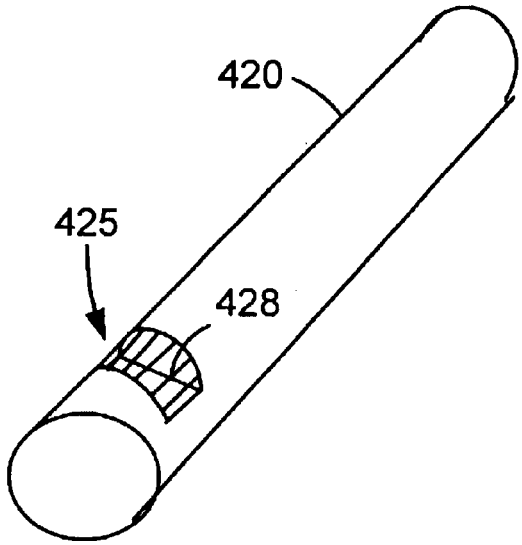

FIGS. 4A and 4B show a multipole rod 410 and an accelerating rod 420, respectively. The multipole rod 410 and the accelerating rod 420 can be used in rod assemblies, such as rod assemblies 200 and 300 (shown in FIGS. 2A and 3A respectively), for guiding and accelerating/decelerating ions in an ion source assembly.

As shown in FIG. 4A, the multipole rod 410 has a multipole surface 412, e.g., a hyperbolic surface, for generating multipole electric fields. The multipole rod 410 includes an aperture 415 through which a laser beam and/or visible light can irradiate samples. The aperture 415 is covered with a metal mesh 418 for minimizing distortions caused by the aperture 415 in the multipole electric fields generated by the multipole surface 412. In one implementation, the metal mesh 418 is spot-welded on the multipole surface 412.

The metal mesh defines openings through which a laser beam or visible light can pass without substantial distortion. For example, the metal mesh 418 defines openings having a size of about 0.5 mm, or any other size that is smaller than the size of the aperture 415 at the multipole surface 412. The metal mesh 418 defines square shaped openings. In alternative implementations, the metal mesh can define openings with rectangular, circular or any other shape.

As shown in FIG. 4B, the accelerating rod 420, which is configured to generate electric fields for accelerating ions, includes a recess 425 through which a laser beam and/or visible light can irradiate samples. The recess 425 is covered with a metal mesh 428 for minimizing distortions caused by the recess 425 in the electric fields generated by the accelerating rod 420.

The invention has been described in terms of particular embodiments. Other embodiments are within the scope of the following claims. For example, the steps of the invention can be performed in a different order and still achieve desirable results.

What is claimed is:

1. An ion source assembly for laser desorption mass spectrometry, the ion source assembly comprising:

a target for receiving analyte samples; and a plurality of rods defining an interior volume having an axis extending away from a surface of the target for transporting ions, one or more of the rods including an aperture defining an opening through a cross-section of the rod, the aperture being configured such that a laser beam can pass through the aperture to irradiate a location on the target surface to generate ions from an analyte sample deposited at the location.

2. The ion source assembly of claim 1, wherein the ion source assembly is included in a matrix assisted laser desorption ion source.

3. The ion source assembly of claim 1, wherein:

the plurality of rods includes multipole rods, each of the multipole rods defining a multipole surface configured to generate multipole electric fields in the interior volume.

4. The ion source assembly of claim 3, wherein:

one of the rods including an aperture is a multipole rod defining the aperture through the multipole surface of the multipole rod.

5. The ion source assembly of claim 4, wherein:

the aperture through the multipole rod has a minor diameter between about 1.0 mm and about 2.5 mm at the multipole surface.

6. The ion source assembly of claim 5, wherein:

the aperture through the multipole rod has a minor diameter that is between about 1.3 mm and about 2.0 mm at the multipole surface.

7. The ion source assembly of claim 4, further comprising:

a metal mesh covering the aperture through the multipole rod at the multipole surface.

8. The ion source assembly of claim 7, wherein:

the metal mesh defines a plurality of openings, each opening having a linear size of about 0.5 mm.

9. The ion source assembly of claim 1, wherein:

one or more of the rods including an aperture defines the aperture by a recess.

10. The ion source assembly of claim 1, wherein:

the plurality of rods includes accelerating rods configured to accelerate or decelerate ions along the axis of the interior volume.

11. The ion source assembly of claim 10, wherein:

one of the rods including an aperture is an accelerating rod defining the aperture by a recess.

12. The ion source assembly of claim 1, wherein:

in one or more of the rods including an aperture, the aperture is configured such that a laser beam can pass through the aperture at an incident angle that is less than sixty degrees relative to the axis of the interior volume.

13. The ion source assembly of claim 12, wherein:

the incident angle of the laser beam is about thirty-two degrees relative to the axis of the interior volume.

14. The ion source assembly of claim 1, wherein:

the target for receiving an analyte sample is defined by indentation on a sample plate.

15. The ion source assembly of claim 1, further comprising:

an optical component configured to irradiate a location on the target surface with a laser beam through an aperture in one of the rods.

16. The ion source assembly of claim 15, further comprising:

an imaging component configured to image the target surface using visible light passing through the aperture used by the laser beam irradiating the target surface.

17. The ion source assembly of claim 16, wherein:

the optical component includes a dichroic mirror to direct the laser beam to the target surface and visible light to the imaging component.

18. A method for generating ions in an ion source assembly for laser desorption mass spectrometry, the method comprising:

positioning in the assembly a target including an analyte sample; and irradiating with a laser beam a location on the analyte sample to generate analyte ions, the laser beam passing through an aperture defined by an opening through a cross-section of one of a plurality of rods in the ion source assembly, the plurality of rods being configured to transport the generated analyte ions.

19. The method of claim 18, further comprising:

transporting the generated analyte ions in an interior volume defined by the plurality of rods, the interior volume having an axis extending away from a surface of the target.

20. The method of claim 19, wherein the plurality of rods includes multipole rods an:

transporting the generated analyte ions in the interior volume includes generating multipole electric fields in the interior volume with the multipole rods in the plurality of rods.

21. The method of claim 20, wherein:

irradiating with a laser beam a location on the analyte sample includes irradiating with a laser beam that passes through an aperture in one of the multipole rods.

22. The method of claim 21, wherein:

irradiating with a laser beam a location on the analyte sample includes irradiating with a laser beam that passes through a metal mesh covering the aperture in one of the multipole rods.

23. The method of claim 19, wherein:

irradiating with a laser beam a location on the analyte sample includes irradiating with a laser beam that passes through the aperture at an incident angle that is less than sixty degrees relative to the axis of the interior volume.

* * * * *